US005462574A

United States Patent [19]

During et al.

[11] Patent Number: 5,462,574

[45] Date of Patent: Oct. 31, 1995

[54] SINTERED CARBONITRIDE ALLOY AND METHOD OF PRODUCING

[75] Inventors: Niclas During, Upplands Vasby; Gerold Weinl, Alvsjo, both of Sweden

[73] Assignee: Sandvik AB, Sandviken, Sweden

[21] Appl. No.: 77,683

[22] Filed: Jun. 16, 1993

[30] Foreign Application Priority Data

Jul. 6, 1992 [SE] Sweden ..... 9202091

[51] Int. Cl.[6] ..... C22C 29/04

[52] U.S. Cl. ..... 75/238; 75/239; 75/240; 75/241; 75/242

[58] Field of Search ..... 75/238, 239, 240, 75/241, 242

[56] References Cited

U.S. PATENT DOCUMENTS

| | | | |
|---|---|---|---|
| 3,971,656 | 7/1976 | Rudy | 75/203 |
| 4,857,108 | 8/1989 | Brandt et al. | 75/238 |
| 4,957,548 | 9/1990 | Shima et al. | 75/238 |
| 5,032,174 | 7/1991 | Ekeman et al. | 75/354 |
| 5,051,126 | 9/1991 | Yasui et al. | 75/238 |
| 5,137,565 | 8/1992 | Thelin et al. | 75/238 |
| 5,147,831 | 9/1992 | Zeininger | 501/96 |
| 5,149,361 | 9/1992 | Iyori et al. | 75/233 |
| 5,186,739 | 2/1993 | Isobe et al. | 75/238 |

*Primary Examiner*—Ngoclan Mai

*Attorney, Agent, or Firm*—Burns, Doane, Swecker & Mathis

[57] ABSTRACT

There is provided a sintered titanium-based carbonitride alloy for metal cutting containing hard constituents based on Ti, Zr, Hf, V, Nb, Ta, Cr, Mo and/or W and 3–30% binder phase based on Co and/or Ni. The structure contains 10–50% by weight well-dispersed Ti-rich hard constituent grains essentially without core-rim structure with a mean grain size of 0.8–5 μm in a conventional carbonitride alloy matrix with a mean grain size of the hard constituents of 1–2 μm. The Ti-rich hard constituent grains are essentially rounded, non-angular grains with an approximately logarithmic normal grain size distribution with a standard deviation of <0.23 logarithmic μm.

4 Claims, 4 Drawing Sheets

SINTERED CARBONITRIDE ALLOY AND METHOD OF PRODUCING

BACKGROUND OF THE INVENTION

The present invention relates to a sintered body of carbonitride alloy with titanium as the main component with improved properties particularly when used as the material for inserts in cutting tools for machining of metals such as turning, milling and drilling.

Sintered titanium-based carbonitride alloys, so-called cermets, are today well established as insert material in the metal cutting industry and are used especially for finishing. They contain mainly carbonitride hard constituents embedded in a binder phase. The hard constituent grains generally have a complex structure with a core surrounded by a rim of other composition. Their grain size is usually 1–2 μm.

In addition to Ti, other metals of the groups IVA, VA Hf, V, Nb, Ta, Cr, Mo and/or W, are normally found in the carbonitride hard constituents but may also be present as carbide and/or nitride hard constituents. The binder phase generally contains cobalt as well as nickel. The amount of binder phase is generally 3–30% by weight.

It is known that different kinds of core-rim structures can be created by adding different alloying elements to a titanium-based carbonitride alloy. By changing the core-rim structure, it is possible, e.g., to change the wettability in order to facilitate sintering. It is also possible to change the properties of the sintered body, for example, to increase the toughness or resistance against plastic deformation as disclosed in, e.g., U.S. Pat. Nos. 3,971,656 and 4,857,108 and Swedish Application No. 8902306-3.

The positive effects of the rim phase stated above has to be balanced with the fact that the rim phase is as brittle but not as hard as the core phase. This is believed to result in crack propagation being concentrated to the rims.

The rims are formed during sintering. The amount of rim that grows on a core is dependent on the sintering temperature and on the chemical composition of the alloy and the core. It is generally believed that the amount of rim formed on a core decreases with increasing amount of nitrogen in the alloy. For alloys with N/(C+N)>0.5, hardly any rims at all are found.

U.S. Pat. No. 4,957,548 discloses a titanium-based carbonitride alloy containing 50% by volume or less particles of TiN or TiCN with N≧C with no core-rim structure. The starting materials are milled in the conventional way and, thus, have an angular grain morphology.

During liquid phase sintering, grain growth is driven by an Ostwall ripening process. For WC-Co alloys, the grain growth of the WC is highly orientated. This orientated growth also exists in titanium-based carbonitride alloys. It is mainly the rims on Ti-containing cores that exhibits this growth orientation. This is evident from the micrograph, FIG. 1, where angular Ti containing cores can be seen. The core-rim interface is straight lined/plane and the interfaces are orientated to certain low energetic crystallographic planes. On top of these cores, rims have grown on the straight lined interface. The interfaces between these rims and the binder phase are also angular and have a low energetic interface plane. All this is even better shown in the TEM micrographs (FIGS. 2 and 3).

OBJECTS AND SUMMARY OF THE INVENTION

It is an object of this invention to avoid or alleviate the problems of the prior art.

It is further an object of this invention to provide an improved method for making a sintered body of carbonitride alloy having titanium as the main component having improved properties particularly when used as the material for inserts in cutting tools for machining of metals such as turning, milling and drilling.

It is also an object of this invention to provide an improved sintered body of carbonitride alloy with titanium as the main component.

In one aspect of the invention there is provided a sintered titanium-based carbonitride alloy for metal cutting purposes containing hard constituents based on Ti, Zr, Hf, V, Nb, Ta, Cr, Mo and/or W with a nitrogen content satisfying the relation N/(C+N)<0.5 and 3–30% binder phase based on Co and/or Ni, said alloy containing 10–50% by weight of well-dispersed Ti-rich hard constituent grains essentially without core-rim structure and having a mean grain size of 0.8–5 μm in a conventional core-rim carbonitride alloy matrix having a mean grain size of the hard constituents of 1–2 μm, said Ti-rich hard constituent grains being essentially rounded, non-angular grains with an approximately logarithmic normal grain size distribution with a standard deviation of <0.23 logarithmic μm In another aspect of the invention there is provided a method of manufacturing a sintered titanium-based carbonitride alloy where the hard constituents are based on Ti, Zr, Hf, V, Nb, Ta, Cr, Mo and/or W and with 3–30% binder phase based on Co and/or Ni comprising milling at least one Ti-rich hard constituent powder with rounded non-angular grains with a narrow grain size distribution, adding the binder metal, pressing and sintering the mixture.

DETAILED DESCRIPTION OF THE PREFERRED EMBODIMENTS OF THE INVENTION

Figure 1:
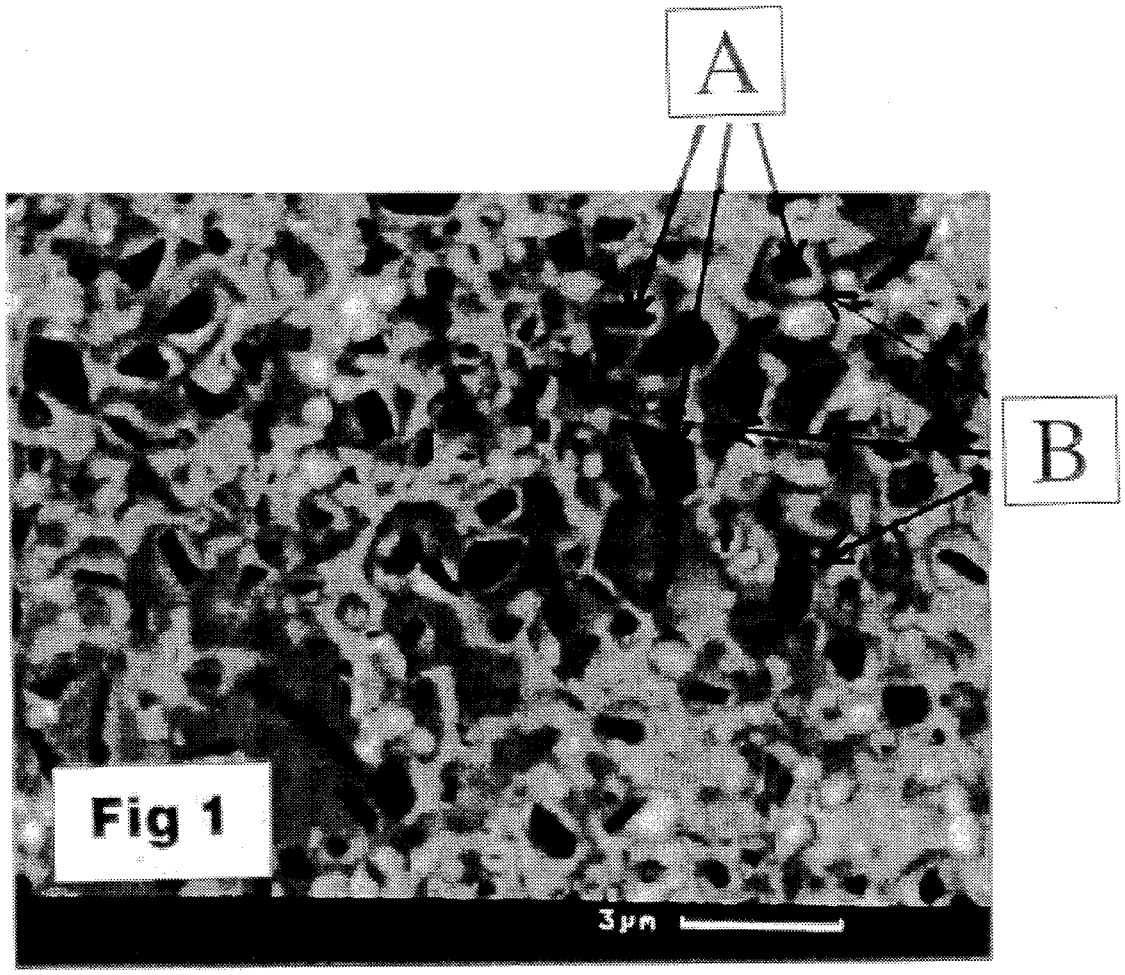
FIG. 1 shows a typical titanium-based carbonitride alloy microstructure in 6000X where A designates cores and B designates rims.
Figure 2:
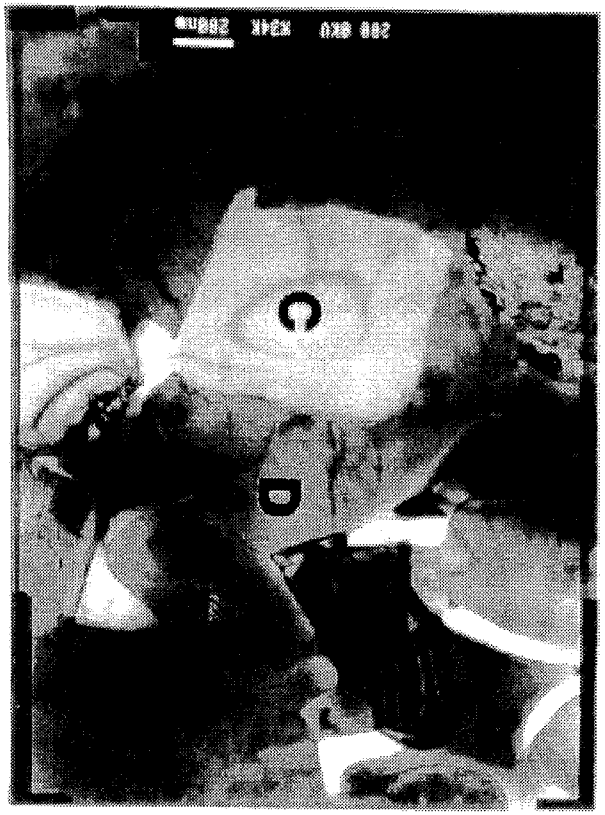
FIGS. 2 and 3 are transmission electron microscope (TEM) micrographs of a typical titanium-based carbonitride alloy microstructure in 35000X and 40000X, respectively, where C designates cores and D designates rims.
Figure 3:
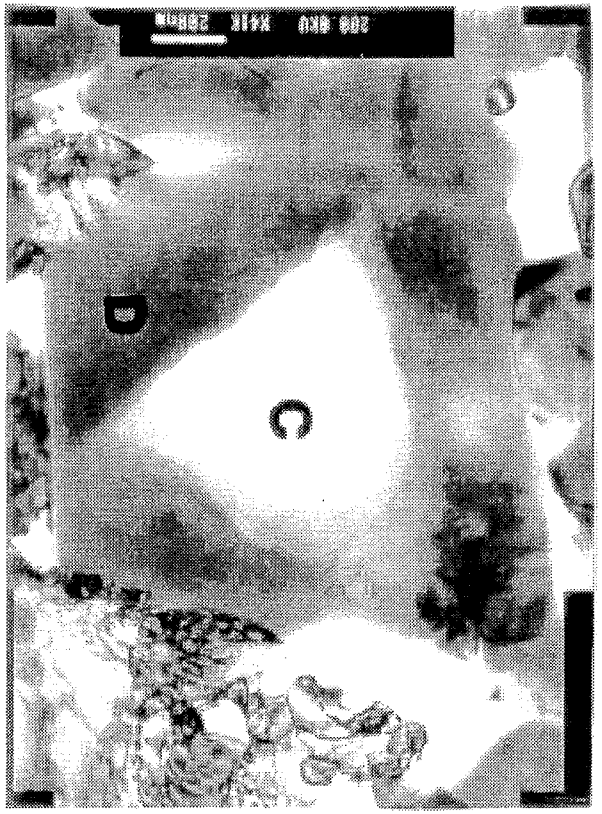

It has now surprisingly been found that the formation of rim phase can be suppressed and the orientated grain growth for a given composition reduced. In this way, the phase relations and the solution of the alloy elements in the binder phase for a given composition are changed. That is accomplished by the choice of grain size distribution and grain morphology. This is to be compared with the prior art method of changing the phase relations by changing the gross composition or, alternatively, changing the composition of the raw material and keeping the gross composition constant.

According to the invention, there is now provided a titanium-based carbonitride alloy with a nitrogen content satisfying the relation N/(N+C)<0.5 with improved toughness behavior and higher resistance against flank wear. The alloy is characterized by a microstructure containing 10–50%, preferably 20–40%, by weight well-dispersed Ti-rich hard constituent grains essentially without core-rim structure with a mean grain size of 0.8–5 μm in a conventional titanium-based carbonitride alloy matrix with a mean grain size of the hard constituents of 1–2 μm. To the extent that the core-rim structure appears in the microstructure, the rim structure only appears on a few percent of the cores and that the core, when appearing, is much thinner than usual. In addition, the microstructure almost completely lacks angular Ti-rich cores, at most, a minor percentage of such angular Ti-rich core. The oxygen content should be kept low, maximum 0.5 weight %, in addition to unavoidable impurities. An alloy according to the invention has 10–25% lower amount of rim phase and 10–15% higher amount of Ti-rich cores compared to a prior an alloy with the same composition.

By titanium-rich is meant herein that >95 % of the metal content of the hard constituents consists of titanium.

The Ti-rich hard constituent grains are carbonitride and are rounded, non-angular grains with a logarithmic normal drain size distribution with a standard deviation of <0.23 logarithmic μm. In addition, they are produced by directly of carbonitriding the metals or their oxides.

In a preferred embodiment, the Ti-rich hard constituent consists of TiCN with C≧N.

The invention also relates to a way of manufacturing a titanium-based carbonitride alloy by powder metallurgical methods. Powders forming binder phase and powders forming hard constituents are mixed to form a mixture of desired composition. From that mixture, bodies are pressed and subsequently sintered.

In-the manufacture of the alloy according to the invention, >90%, preferably >95%, of the Ti-rich raw materials are added as powder with a narrow grain size distribution and rounded, non-angular grains. That powder is carefully mixed with the rest of the other conventional raw materials in such a way that the rounded morphology of the grains is not affected and yet a homogenous mixture is obtained. With conventional hard constituents, raw materials is meant herein material milled to final grain size.

The alloy composition formed by mixing single carbides or nitrides such a TiC, WC, TaN, etc., or by mixing complex carbides, nitrides and/or carbonitrides such as (Ti,Ta)C, (Ti,Ta)(C,N), etc., or mixing a combination of both kinds of starting materials.

Figure 4:
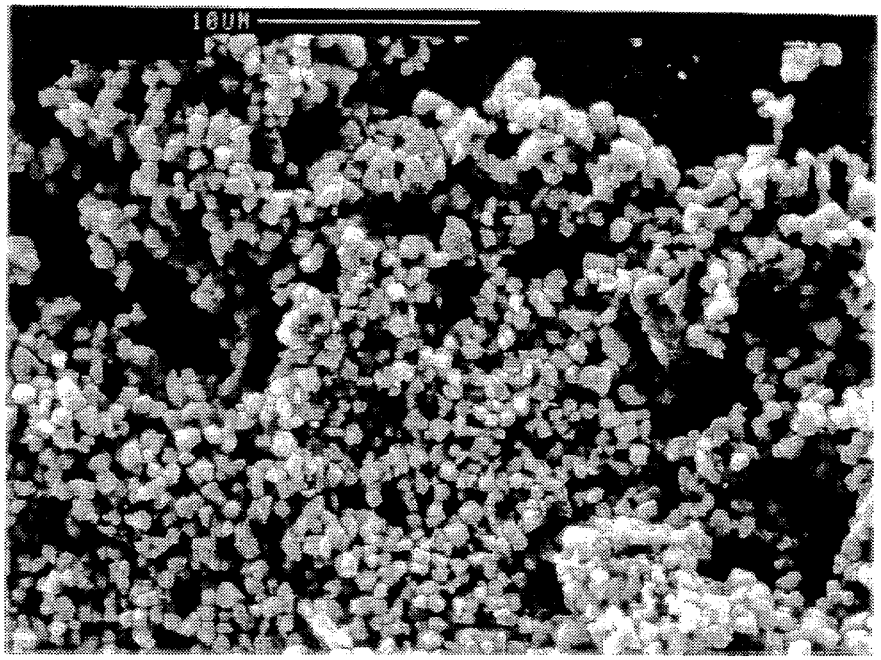
FIGS. 4 and 5 show two different powders in 3000X.
Figure 5:
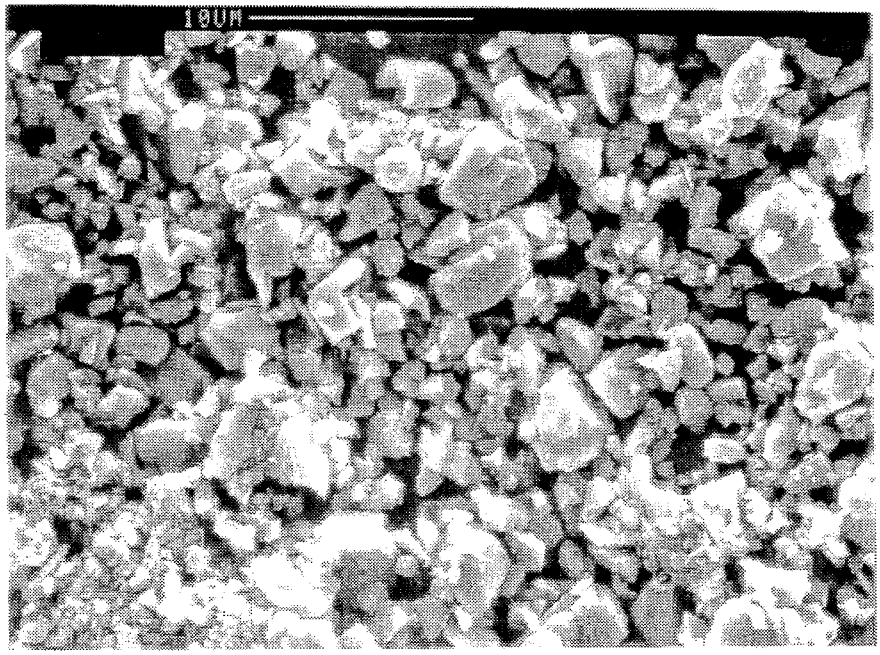

The Ti-rich raw material(s) shall have a mean grain size between 0.3 and 5 μm, preferably between 0.5 and 2 μm, according to the FSSS-method (Fisher Sub Sieve Sizer-Method)with a narrow grain size distribution. If the grain size distribution, measured, e.g., by sedimentation technique, is approximated to a logarithmic normal distribution, its standard deviation shall be less than 0.23 logarithmic μm. The grain morphology is essentially rounded, non-angular grains. An acceptable morphology is shown in FIG. 4 and an unacceptable morphology is shown in FIG. 5. The Ti-rich starting material/s is/are carbides, nitrides and/or carbonitrides of only Ti and/or Ti plus a small amount, <5 %, of one or more of Zr, Hf, V, Nb, Ta, Cr, Mo and W.

The mixing of the starting materials can be made in two principal ways. One way is first to mill all starting materials, except the Ti-rich ones, together with press-additives in a suitable solvent, for example, ethanol. When the desired grain size is reached, the Ti-rich standard materials are added and milled for a very short time until the Ti-rich material is evenly distributed.

The other principal way is to mix all the standard material and press-additives in a suitable solvent, for example, ethanol, and mix it just as carefully as the final mixing stated above. The latter method puts higher demands on all the included standard materials in order to get an even distribution without ruining the morphology of the Ti-rich standard material.

The invention is additionally illustrated in connection with the following Examples which are to be considered as illustrative of the present invention. It should be understood, however, that the invention is not limited to the specific details of the Examples.

Example 1

Two alloys were prepared each having the following composition in % by weight: Ti(C,N)23; (Ti,Ta)C23; (Ti,Ta)(C,N)15, WC18, $Mo_2C5$, Co 8 and Ni 8.

Alloy A was manufactured from conventional raw material with morphology as shown in FIG. 5. The raw materials were milled together for 20 hours in a ball mill.

Alloy B was manufactured using Ti(C,N) raw materials with a morphology similar to that shown in FIG. 4 with a mean grain size 1.4 μm measured according to the FSSS method and a grain size distribution with a standard deviation of 0.19 logarithmic μm a measured by sedimentation technique. The other hard constituent raw materials had a morphology similar to that shown in FIG. 5. The raw materials, except Ti(C,N), were mixed in a ball mill for 14 hours and then the Ti(C,N) was added and the milling was continued for another 6 hours.

After mixing, both powder mixtures were treated in the same way, i.e., spray drying, compacting and sintering according to known techniques.

Figure 6:
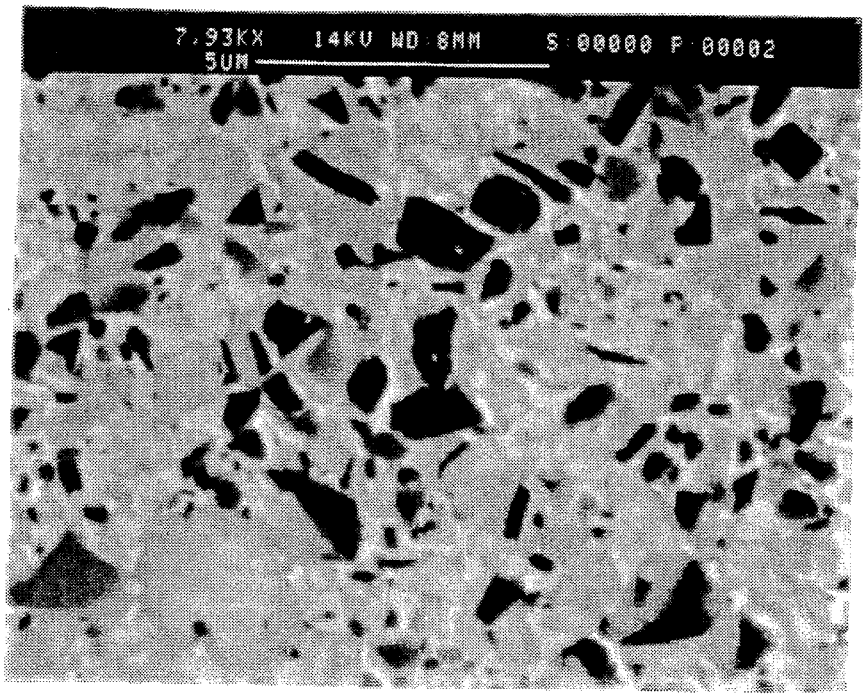
FIG. 6 shows the microstructure of a prior art alloy in 8000X.
Figure 7:
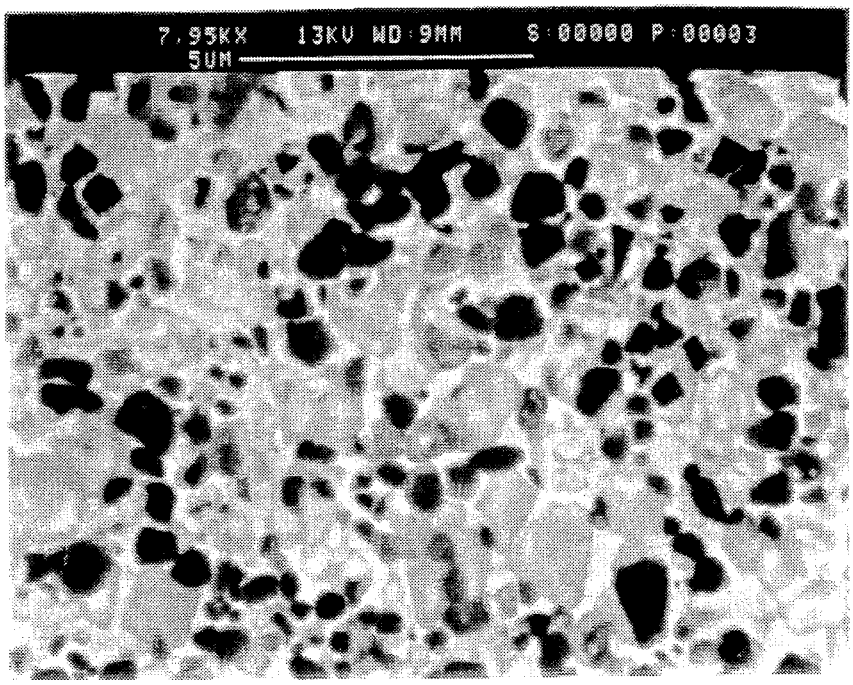
FIG. 7 shows the microstructure of an alloy according to the invention in 8000X.

The microstructures of alloy A is shown in FIG. 6 and of alloy B in FIG. 7. Note the large differences in amount of Ti-rich phase (dark color) and the difference in morphology of the hard phases between the alloys. A rough quantitative phase analysis gives the following approximate phase quantities in % by volume.

| | Prior Art (A) | Invention (B) |
|---|---|---|
| Dark cores | 18% | 30% |
| Light grey cores | 16% | 15% |
| Medium grey cores | 2% | 2% |
| Rest (binder phase and rims) | 64% | 53% |

Example 2

Alloy A and B were compared in two cutting tests.

In test no. 1, the toughness in milling was determined. 15 edges per alloy were run with increasing feed rate. The feed rate that caused chipping/breakage was recorded. Cutting data were depth of cut-2.0 mm and speed=129 mm/min. Workpiece material was SS2541 with hardness 320 HB.

The result was that 50 % of edges from alloy A had fractured at the feed of 0.3 mm/rev and tooth and for alloy B, 50% breakage happened at the feed 0.41 mm/rev and tooth.

In test no. 2, the flank wear resistance was determined in a milling operation. Cutting data were depth of cut=2.0 mm, speed=459 m/min and feed=0.12 mm/rev and tooth. Workpiece material was SS1672 with hardness 215 HB.

In this test alloy B had 10% less flank wear and 10% longer tool life than alloy A.

In conclusion, the cutting test shows that the alloy according to the invention has increased toughness and wear resistance.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A sintered titanium-based carbonitride alloy for metal cutting purposes containing hard constituents based on Ti, Zr, Hf, V, Nb, Ta, Cr, Mo and/or W with a nitrogen content satisfying the relation $N/(C+N)<0.5$ and 3–30% binder phase based on Co and/or Ni, said hard constituents including well-dispersed Ti-rich hard constituent grains without a core-rim structure and metal carbonitride constituent grains having a core-rim structure, said alloy containing 10–50% by weight of said well-dispersed Ti-rich hard constituent grains having a mean grain size of 0.8–5 μm in a matrix of said metal carbonitride constituent grains having a mean grain size of 1–2 μm, said Ti-rich hard constituent grains being essentially rounded, non-angular grains with an approximately logarithmic normal grain size distribution with a standard deviation of <0.23 logarithmic μm.

2. The sintered carbonitride alloy of claim 1 wherein said core-rim constituents almost completely lack angular Ti-rich cores.

3. The sintered carbonitride alloy of claim 1 wherein said Ti-rich hard constituent grains have been directly produced by carbonitriding of the metals or their oxides.

4. The sintered carbonitride alloy of claim 1 wherein said Ti-rich hard constituent is TiC or TiCN with $C \geqq N$.

* * * * *